United States Patent [19]

Russell

[11] 4,122,984

[45] Oct. 31, 1978

[54] POCKET SCABBARD FOR KNIFE

[76] Inventor: A. G. Russell, 1705 Highway 71 N., Springdale, Ark. 72764

[21] Appl. No.: 761,466

[22] Filed: Jan. 21, 1977

[51] Int. Cl.[2] ..... F41B 13/04

[52] U.S. Cl. ..... 224/2 D; 224/26 R

[58] Field of Search ..... 224/2 B, 2 C, 2 D, 26 R, 224/26 B, 1 R, 5 R, 5 A, 5 B, 4 A, 5 H

[56] References Cited

U.S. PATENT DOCUMENTS

| | | | |
|---|---|---|---|
| 309,292 | 12/1884 | Browne | 224/2 B |
| 317,128 | 5/1885 | Hanscom | 224/2 B |
| 2,527,711 | 10/1950 | Davidson | 224/2 D X |
| 3,406,884 | 10/1968 | Perkins | 224/2 B |

*Primary Examiner*—Trygve M. Blix

*Assistant Examiner*—Jerold M. Forsberg

*Attorney, Agent, or Firm*—William R. Laney

[57] ABSTRACT

A pocket scabbard for a knife comprising a first flexible, generally rectangular panel having a knife-receiving slot therein and second and third panels secured to said first panel on opposite sides thereof and over said slot to close the opposite sides of said slot and define a knife-receiving recess opening at one side of the first rectangular panel. Each of said second and third panels is characterized in having a side edge conforming in shape to an edge of said first panel, and positioned to coincide with said first panel edge. The second and third panels each define cavities which cooperate mutually and with the slot in said first panel to define a pocket for receiving the handle of a knife inserted therein.

1 Claim, 4 Drawing Figures

POCKET SCABBARD FOR KNIFE

BACKGROUND OF THE INVENTION

1. Field of the Invention

This invention relates to a pocket scabbard for a knife, and more particularly, to a scabbard adapted to fit in the rear pocket of a pair of trousers to protectively contain and encase a knife in a fixed, easily accessible position.

2. Brief Description of the Prior Art

Many types of knife scabbards have been previously proposed and constructed for the purpose of encasing and sheathing a knife when it is not in use, and permitting the knife, at this time, to be carried at some location on the person of the user. Many of these scabbards have been constructed of leather, and have included an appropriately located slot which facilitates the hanging of the scabbard from the user's belt. Where the loop is a closed loop, it is, of course, necessary that the belt be inserted and removed at times when it is desired to locate the knife scabbard on the belt, or to remove it therefrom. This is an inconvenient procedure at times during a hunting expedition when it may be desired to have the knife and its scabbard detached from the belt to be passed to another person, or to be stored at the campsite for general usage.

Smaller types of knives, such as pocket knives, are often carried in the pocket of the user, and are there generally accessible and easily reached, unless the pocket is filled with change, keys or other miscellaneous items which prevent quick and ready access to the pocket knife.

BRIEF DESCRIPTION OF THE PRESENT INVENTION

The present invention comprises a pocket scabbard for a small knife which is shaped to permit it to be slipped into the rear pocket of a pair of trousers in a position such that it does not occupy a large portion of the total pocket volume or space inside the pocket, and yet is configured so that it is retained in the pocket and is not easily lost therefrom. The scabbard is constructed of three flexible, preferably leather, panels which are superimposed or sandwiched in such a way to define a blade-receiving slot and a handle-receiving pocket for receiving and encasing all but the upper end of the handle portion of a knife placed in the scabbard. The entire structure is compact in construction and is relatively thin so as to permit wallets, a handkerchief or other items commonly carried in the rear pocket or trousers to be carried therein conjunctively with the scabbard.

Broadly described, the pocket scabbard includes a first flexible, generally rectangular panel which has a knife-receiving slot therein extending into this panel from one edge of the panel. Second and third panels are provided in an overlying position with respect to the first panel, and are secured to opposite sides of the first panel so as to close the opposite sides of the slot in the first panel, and thereby define a knife-receiving recess which opens at one side edge of the first panel. Each of the second and third panels is characterized in having a side edge which conforms in shape to an edge of the first panel, and is positioned to coincide with this edge of the first panel. The second and third panels also define cavities which cooperate mutually with the slot in the first panel to define a pocket which snugly receives a major portion of the handle of the knife so as to frictionally retain the knife in the scabbard and permit the top of the handle to project slightly above the top edge of the scabbard.

An important object of the present invention is to provide a pocket scabbard which can be slipped easily into the rear pocket of a pair of trousers and to be retained securely therein against inadvertent loss from the pocket.

Another object of the invention is to provide a pocket scabbard which is relatively thin and compact in construction so that it may be utilized in the rear pocket of a pair of trousers without perempting use of the pocket for containment of a wallet, a handkerchief or the like.

A further object of the invention is to provide a pocket scabbard which is constructed of relatively few pieces of flexible material, such as leather, and which firmly retains a knife positioned therein against inadvertent loss or removal while providing relatively quick and convenient access to the upper end of the knife handle to permit the knife to be removed instantly from the scabbard when it is to be used.

Additional objects and advantages of the invention will become apparent as the following detailed description of a preferred embodiment of the invention is read in conjunction with the accompanying drawing which illustrates such preferred embodiment.

GENERAL DESCRIPTION OF THE DRAWINGS

DETAILED DESCRIPTION OF A PREFERRED EMBODIMENT OF THE INVENTION

Figure 1:
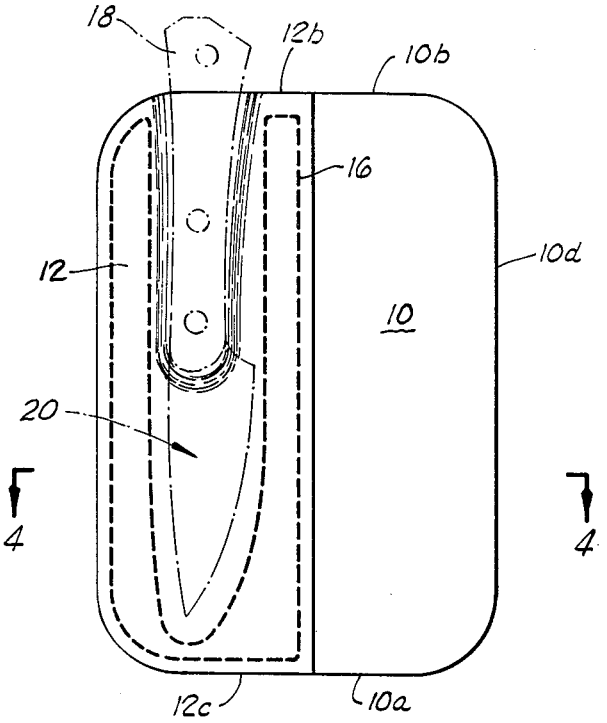
FIG. 1 is a front elevation view of a pocket scabbard constructed in accordance with the present invention.
Figure 2:
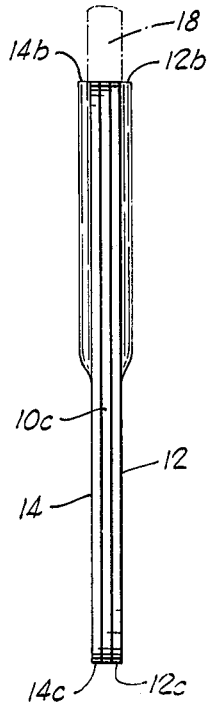
FIG. 2 is a side elevation view of the pocket scabbard depicted in FIG. 1.

The pocket scabbard of the invenion includes a first panel 10 of rectangular configuration, and formed of a flexible material, such as leather or synthetic leather. The panel 10 is sized to fit within the rear pocket of a pair of trousers, and is formed with its edges interconnected through radiused corners as illustrated. The panel 10 includes a bottom edge **10*a*, a top edge 10*b* and two side edges 10*c* and 10*d*. The panel 10 has an elongated, knife-receiving slot 10*e* formed in the panel and opening in the top edge 10*b* in the manner illustrated by the dashed line in FIG. 1**.

The knife-receiving slot **10*e* is covered by a pair of panels 12 and 14 which are sewn to opposite sides of the panel 10. The stitching utilized for sewing the panels 12 and 14 to the opposite sides of the panel 10 is designated by reference numeral 16**, and projects through the three superimposed panels to afford the necessary securement.

Figure 3:
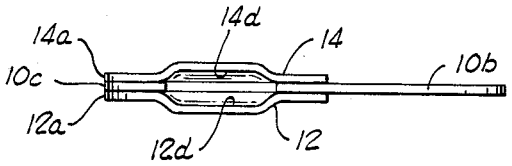
FIG. 3 is a plan view of the pocket scabbard depicted in FIG. 1
Figure 4:
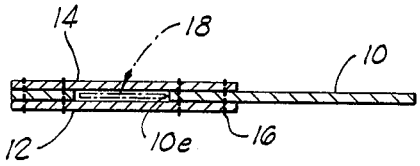
FIG. 4 is a sectional view taken along line 4—4 of FIG. 1.

The panels 12 and 14 are characterized in having side edges **12*a* and 14*a*, respectively, which conform in shape or configuration to the side edge 10*c* of the panel 10, and the edges 12*a* and 14*a* are aligned in coincidence with the edge 10*c* as shown in FIGS. 1 and 3. The panels 12 and 14 are also characterized in having top edges 12*b* and 14*b* which extend along, and are alinged with, a portion of the top edge 10*b* of the panel 10, and bottom edges 12*c* and 14*c* which extend along, and are aligned with, a portion of the bottom edge 10*a* of the panel 10. Each of the panels 12 and 14 is approximately one-half the width of the panel 10**.

In the manufacture of the panels 12 and 14, these panels are formed with recesses or cavities 12*d* and 14*d*, respectively, extending along the panels from the top edges 12*b* and 14*b*, respectively. When the panels 12 and 14 are sewn to the panel 10 in the position illustrated, the recesses or cavities 12*d* and 14*d* in the two panels mutually cooperate and are aligned on opposite sides of the slot 10*e* formed in the panel 10 to define a pocket for receiving the handle 18 of a knife carried in the scabbard, and designated generally by reference numeral 20. The handle 18 protrudes or projects on opposite sides of the projected plane of the knife blade. It will be noted in referring to FIG. 1 that the handle-receiving pocket defined by the cavities 12*d* and 14*d* terminates a distance above the lower end of the slot 10*e* formed in the panel 10 such that the tip or point of the knife blade is spaced above the lower end of the slot. It will also be noted that the stitching 16 by which the panels 12 and 14 are secured to the panel 10 extends along lines spaced outwardly from the defining inner edge of the slot 10*e* so that a portion of the panel 10 which is adjacent, and terminates at, the slot 10*d* is positioned closer to the knife blade than is the stitching. It will be further noted that the cross-sectional transverse dimension of the pocket for receiving the handle 18 is at least twice as great as the cross-sectional transverse dimension of the knife receiving slot 10*e*.

It will be perceived that the pocket scabbard of the invention is very thin, and thus can be placed in a trousers pocket without occupying so much space that a wallet or handkerchief cannot be easily and confortably carried in the pocket simultaneously with the scabbard. Further, the size of the panel 10 is such that looseness or play between the scabbard and the walls of the pocket cannot develop so as to permit the scabbard to be easily lost or displaced from the pocket. It will also be noted that the knife 18, when placed in the scabbard, is firmly retained by frictional contact with the handle-receiving pocket defined by the cooperating cavities or recesses 12*d* and 14*d* in the panels 12 and 14, and that the blade of the knife is partially blocked from contact with the stitching 16 by the protuberant or projecting inner edge of the panel 10 which lies adjacent the slot 10*e*. The scabbard is also configured in relation to the size of the knife 20 to present the upper end portion of the handle of the knife to easy access at such time as it is desired to quickly pull the knife from the scabbard for use.

Although a preferred embodiment of the invention has been herein described, it will be understood that various changes and modifications in the illustrated and described embodiment can be effected without departure from the basic principles of the invention, and such changes and modifications are deemed to be circumscribed by the spirit and scope of the invention except as the same may be necessarily limited by the appended claims, or reasonable equivalents thereof.

What is claimed is:

1. A pocket scabbard for a knife comprising:

a first pocket-sized flexible panel of rectangular configuration, having two opposed, substantially parallel side edges, a top edge and a bottom edge and further having a knife-receiving slot opening at said top edge;

second and third panels of rectangular configuration secured to said first panel on opposite sides thereof and each having a side edge aligned in coincidence with one side edge of said first panel and each having a second edge aligned in coincidence with said bottom edge of said first panel, said second and third panels covering said slot except for the opening thereof, each of said second and third panels defining a cavity aligned with said slot, said cavities and slot together forming a handle-receiving pocket for snugly receiving and frictionally engaging the handle of a knife placed in said scabbard and for limiting, by the bottom of said handle-receiving pocket as formed by the convergence of said second and third panels, the distance which the blade of said knife can extend into said knife-receiving slot in said first panel, said second and third panels being sewn to each other through said first panel along sew lines spaced from the boundary of the slot in said first panel so that said first panel terminates at the slot at a location between a knife blade in said slot and said sew lines, said pocket formed by said cavities and slot having a depth sized to cause a portion of the handle of a knife placed in said pocket to project beyond said first-mentioned edge of said first panel, and to retain the point of a blade of the knife positioned in said pocket to be spaced from the bottom of said slot, and each of said second and third panels having a width, as measured between the side edges thereof, which is about half the width of said first panel; and the cross-sectional transverse dimension of said handle-receiving pocket, measured between said second panel and said third panel, being at least twice the cross-sectional transverse dimension of said knife-receiving slot.

* * * * *